US006548465B2

(12) United States Patent
Perry et al.

(10) Patent No.: US 6,548,465 B2
(45) Date of Patent: Apr. 15, 2003

(54) SILOXANE DRY CLEANING COMPOSITION AND PROCESS

(75) Inventors: Robert J. Perry, Niskayuna, NY (US); Donna Ann Riccio, Watervliet, NY (US); Larry D. Ryan, Waterford, NY (US)

(73) Assignee: General Electric Company, Pittsfield, MA (US)

( * ) Notice: Subject to any disclaimer, the term of this patent is extended or adjusted under 35 U.S.C. 154(b) by 0 days.

(21) Appl. No.: 09/736,880

(22) Filed: Dec. 14, 2000

(65) Prior Publication Data

US 2002/0174493 A1 Nov. 28, 2002

Related U.S. Application Data

(60) Provisional application No. 60/188,244, filed on Mar. 10, 2000.

(51) Int. Cl.[7] ..... C11D 3/30
(52) U.S. Cl. ..... 510/285
(58) Field of Search ..... 510/285; 424/70, 424/122

(56) References Cited

U.S. PATENT DOCUMENTS

| | | | | |
|---|---|---|---|---|
| 4,005,231 A | | 1/1977 | Smith | |
| 4,065,258 A | | 12/1977 | France | |
| 4,685,930 A | | 8/1987 | Kasprzak | |
| 4,693,840 A | * | 9/1987 | Trinh et al. | 252/174.23 |
| 4,911,853 A | | 3/1990 | Coffindaffer et al. | |
| 5,326,387 A | * | 7/1994 | Faber et al. | 106/3 |
| 5,389,363 A | * | 2/1995 | Snyder et al. | 424/70.7 |
| 5,518,716 A | * | 5/1996 | Riccio et al. | 424/70.1 |
| 5,676,705 A | | 10/1997 | Jureller et al. | |
| 5,865,852 A | | 2/1999 | Berndt | |
| 5,942,007 A | | 8/1999 | Berndt et al. | |
| 5,977,040 A | | 11/1999 | Inada et al. | |
| 6,042,617 A | | 3/2000 | Berndt | |
| 6,042,618 A | | 3/2000 | Berndt et al. | |
| 6,056,789 A | | 5/2000 | Berndt et al. | |
| 6,059,845 A | | 5/2000 | Berndt et al. | |
| 6,063,135 A | | 5/2000 | Berndt et al. | |

FOREIGN PATENT DOCUMENTS

| | | |
|---|---|---|
| JP | 06327888 | 11/1994 |
| JP | 09299687 | 11/1997 |
| WO | WO 94/01510 | 1/1994 |

OTHER PUBLICATIONS

Chemical Marketing Reporter (newspaper), Dec. 15, 1997 issue, p. 15.

* cited by examiner

*Primary Examiner*—John Hardee
(74) *Attorney, Agent, or Firm*—Kenneth S. Wheelock

(57) ABSTRACT

A dry cleaning composition comprising a volatile siloxane and an aminofunctional siloxane and, optionally water or acid, and a method for dry cleaning comprising contacting an article with a composition comprising a volatile siloxane and an aminofunctional siloxane.

18 Claims, No Drawings

SILOXANE DRY CLEANING COMPOSITION AND PROCESS

CROSS-REFERENCE TO RELATED APPLICATIONS

This application claims rights of priority from U.S. Provisional Patent Application Serial No. 60/188,244, filed Mar. 10, 2000.

TECHNICAL FIELD

The present invention is directed to a dry cleaning composition, more specifically, to a siloxane fluid based composition, for use in dry cleaning and to a dry cleaning process using the composition.

BACKGROUND

Current dry cleaning technology uses perchloroethylene ("PERC") or petroleum-based materials as the cleaning solvent. PERC suffers from toxicity and odor issues. The petroleum-based products are not as effective as PERC in cleaning garments.

Cyclic siloxanes have been reported as spot cleaning solutions, see U.S. Pat. No. 4,685,930, and as dry cleaning fluids in dry cleaning machines, see U.S. Pat. No. 5,942,007. Other patents disclose the use of silicone soaps in petroleum solvents, see JP 09299687, and the use of silicone surfactants in super critical carbon dioxide solutions has been reported, see, for example, U.S. Pat. No. 5,676,705 and Chem. Mark. Rep., Dec. 15, 1997, 252(24), p. 15. Non-volatile silicone oils have also been used as the cleaning solvent requiring removal by a second washing with perfluoroalkane to remove the silicone oil, see JP 06327888.

Numerous other patents have issued in which siloxanes or organomodified silicones have been present as addenda in PERC or petroleum based dry cleaning solvents, see, for example, WO 9401510; U.S. Pat. Nos. 4,911,853; 4,005,231; 4,065,258.

There is a continued interest in providing an additive or additives to enhance the cleaning ability of silicone based dry cleaning solvents.

SUMMARY OF THE INVENTION

In a first aspect, the present invention is directed to a dry cleaning composition, comprising a volatile siloxane and one or more aminofunctional siloxanes.

In a second aspect, the present invention is directed to a method for dry cleaning comprising contacting an article with a composition comprising a volatile siloxane and an aminofunctional siloxane.

The process of the present invention exhibits improved performance, such as for example, removal of water soluble stains from the article, for example a garment, being cleaned. The process of the present invention also exhibits improved performance for removal of soluble stains, including oil stains and grease stains.

DETAILED DESCRIPTION OF THE INVENTION

In a preferred embodiment, the composition comprises, based on 100 parts by weight ("pbw") of the composition, from greater than 90 pbw to 99.999 pbw, more preferably from 92 pbw to 99.9 pbw and even more preferably from 95 pbw to 99.5 pbw of the volatile siloxane and from 0.001 pbw to less than 10 pbw, more preferably from 0.01 pbw to 8 pbw and even more preferably from 0.1 pbw to 5 pbw of the aminofunctional siloxane or siloxanes. The volatile siloxane may be linear, branched, cyclic, or a combination thereof. The composition optionally further comprises water, preferably from 0.01 pbw to 15 pbw, more preferably from 0.1 pbw to less than 12 pbw and even more preferably from 0.2 pbw to 10 pbw of water. Preferably, the composition does not include siloxane resins or crosslinking agents. The composition optionally further comprises acid in amounts sufficient to protonate the amino functionality of the aminofunctional silicone.

In a preferred embodiment, the water may be added as "free" water or may be delivered by an emulsion containing other components such as siloxanes, hydrocarbons, surfactants, or other suitable additives. If the water is delivered by an emulsion, the emulsion may be prepared by either homogenization of the components or by mechanically stirring the mixture.

Compounds suitable as the linear or branched, volatile siloxane solvent of the present invention are those containing a polysiloxane structure that includes from 2 to 20 silicon atoms. Preferably, the linear or branched, volatile siloxanes are relatively volatile materials, having, for example, a boiling of below about 300° C. point at a pressure of 760 millimeters of mercury ("mm Hg").

In a preferred embodiment, the linear or branched, volatile siloxane comprises one or more compounds of the structural formula (I):

$$M_{2+y+2z}D_xT_yQ_z \quad \text{(I)}$$

wherein:

M is $R^1{}_3SiO/_{1/2}$;

D is $R^2R^3SiO_{2/2}$;

T is $R^4SiO_{3/2}$;

and Q is $SiO_{4/2}$ $R^1$, $R^2$, $R^3$ and $R^4$ are each independently a monovalent hydrocarbon radical; and x and y are each integers, wherein $0 \leqq x \leqq 10$ and $0 \leqq y \leqq 10$ and $0 \leqq z \leqq 10$.

Suitable monovalent hydrocarbon groups include acyclic hydrocarbon radicals, monovalent alicyclic hydrocarbon radicals, monovalent and aromatic or fluoro containing hydrocarbon radicals. Preferred monovalent hydrocarbon radicals are monovalent alkyl radicals, monovalent aryl radicals and monovalent aralkyl radicals.

As used herein, the term "$(C_1–C_6)$alkyl" means a linear or branched alkyl group containing from 1 to 6 carbons per group, such as, for example, methyl, ethyl, propyl, isopropyl, n-butyl, iso-butyl, sec-butyl, tert-butyl, pentyl, hexyl, preferably methyl.

As used herein, the term "aryl" means a monovalent unsaturated hydrocarbon ring system containing one or more aromatic or fluoro containing rings per group, which may optionally be substituted on the one or more aromatic or fluoro containing rings, preferably with one or more $(C_1–C_6)$ alkyl groups and which, in the case of two or more rings, may be fused rings, including, for example, phenyl, 2,4,6-trimethylphenyl, 2-isopropylmethylphenyl, 1-pentalenyl, naphthyl, anthryl, preferably phenyl.

As used herein, the term "aralkyl" means an aryl derivative of an alkyl group, preferably a $(C_2–C_6)$alkyl group, wherein the alkyl portion of the aryl derivative may, optionally, be interrupted by an oxygen atom, such as, for example, phenylethyl, phenylpropyl, 2-(1-naphthyl)ethyl, preferably phenylpropyl, phenyoxypropyl, biphenyloxypropyl.

In a preferred embodiment, the monovalent hydrocarbon radical is a monovalent $(C_1-C_6)$alkyl radical, most preferably, methyl.

In a preferred embodiment, the linear or branched, volatile siloxane comprises one or more of, hexamethyldisiloxane, octamethyltrisiloxane, decamethyltetrasiloxane, dodecamethylpentasiloxane, tetradecamethylhexasiloxane or hexadecamethylheptasiloxane or methyltris(trimethylsiloxy)silane. In a more highly preferred embodiment, the linear or branched, volatile siloxane of the present invention comprises octamethyltrisiloxane, decamethyltetrasiloxane, or dodecamethylpentasiloxane or methyltris(trimethylsiloxy)silane. In a highly preferred embodiment, the siloxane component of the composition of the present invention consists essentially of decamethyltetrasiloxane.

Suitable linear or branched volatile siloxanes are made by known methods, such as, for example, hydrolysis and condensation of one or more of tetrachlorosilane, methyltrichlorosilane, dimethyldichlorosilane, trimethylchlorosilane, or by isolation of the desired fraction of an equilibrate mixture of hexamethyldisiloxane and octamethylcyclotetrasiloxane or the like and are commercially available.

Compounds suitable as the cyclic siloxane component of the present invention are those containing a polysiloxane ring structure that includes from 2 to 20 silicon atoms in the ring. Preferably, the linear, volatile siloxanes and cyclic siloxanes are relatively volatile materials, having, for example, a boiling point of below about 300° C. at a pressure of 760 millimeters of mercury ("mm Hg").

In a preferred embodiment, the cyclic siloxane component comprises one or more compounds of the structural formula (II):

(II)

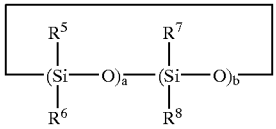

wherein:

$R^5$, $R^6$, $R^7$ and $R^8$ are each independently a monovalent hydrocarbon group; and a and b are each integers wherein $0 \leqq a \leqq 10$ and $0 \leqq b \leqq 10$, provided that $3 \leqq (a+b) \leqq 10$.

In a preferred embodiment, the cyclic siloxane comprises one or more of, octamethylcyclotetrasiloxane, decamethylcyclopentasiloxane, dodecamethylcyclohexasiloxane, tetradecamethylcycloheptasiloxane. In a more highly preferred embodiment, the cyclic siloxane of the present invention comprises octamethylcyclotetrasiloxane or decamethylcyclopentasiloxane. In a highly preferred embodiment, the cyclic siloxane component of the composition of the present invention consists essentially of decamethylcyclopentasiloxane.

Suitable cyclic siloxanes are made by known methods, such as, for example, hydrolysis and condensation of dimethyldichlorosilane and are commercially available.

The aminofunctional silicone comprises structural units of the formula:

$$R^{20}_f SiO_{4-f}$$

wherein at least one $R^{20}$ is $-(CHR^{24})_n NR^{25}R^{26}$ where $R^{24}$ is H or alkyl, preferably $(C_1-C_8)$alkyl, $R^{25}$ is H or alkyl, preferably $(C_1-C_4)$alkyl, $R^{26}$ is H, alkyl, preferably $(C_1-C_8)$alkyl, or $-(CHR^{27})_m NR^{28}R^{29}$ where $R^{27}$ is H or alkyl, preferably $(C_1-C_8)$alkyl and $R^{28}$ and $R^{29}$ are each independently H or alkyl, preferably $(C_1-C_4)$alkyl, n is from 2 to 16, and m is from 2 to 16; and $1 \leqq f \leqq 3$.

In a preferred embodiment, the aminofunctional silicone of the present invention comprises one or more siloxanes selected from block or random polymers and copolymers and terminally substituted aminofunctional siloxane polymers having the structural formula:

$$M^*D_xD'_yT_wT'_zM^* \quad (I)$$

wherein $M^*$ is $R^{21}R^{22}R^{23}SiO_{1/2}$, wherein each $R^{21}$, $R^{22}$ and $R^{23}$ is independently alkyl, preferably $(C_1-C_8)$alkyl, aryl, substituted alkyl or aryl, alkoxy, preferably $(C_1-C_8)$ alkoxy, $-(CH_2)_a(CH_2CH_2O)_b(CH_2CH(CH_3)O)_cR_{15}$, wherein $R^{15}$ is H or alkyl, preferably $(C_1-C_8)$alkyl, a is from 2 to 8 inclusive, b and c are each from 0 to 20 inclusive, or $R^{20}$, as previously defined;

D is $R^{14}{}_2SiO_{2/2}$, wherein each $R^{14}$ is alkyl, preferably $(C_1-C_8)$alkyl or $-(CH_2)_a(CH_2CH_2O)_b(CH_2CH(CH_3)O)_cR^{15}$, wherein $R^{15}$ is H or alkyl, preferably $(C_1-C_8)$ alkyl, a is from 2 to 8 inclusive, b and c are each from 0 to 20 inclusive;

D' is $R_{10}R_{11}SiO_{2/2}$, wherein $R^{10}$ is alkyl, preferably $(C_1-C_8)$alkyl, aryl, or $-(CH_2)_a(CH_2CH_2O)_b(CH_2CH(CH_3)O)_cR^{15}$, wherein $R^{15}$ is H or alkyl, preferably $(C_1-C_8)$alkyl, a is from 2 to 8 inclusive, b and c are each from 0 to 20 inclusive, and $R^{11}$ is $R^{20}$, as previously defined, or polyether, alkyl, aryl, or other functional side group;

T is $R^{12}SiO_{3/2}$, wherein $R^{12}$ is alkyl or aryl, preferably $(C_1-C_8)$alkyl or $-(CH_2)_a(CH_2CH_2O)_b(CH_2CH(CH_3)O)_cR^{15}$, wherein $R^{15}$ is H or alkyl, preferably $(C_1-C_8)$ alkyl;

T' is $R^{13}SiO_{3/2}$, wherein $R^{13}$ is alkyl, preferably $(C_1-C_8)$ alkyl, aryl, or $-(CH_2)_a(CH_2CH_2O)_b(CH_2CH(CH_3)O)_c R_{15}$, wherein $R^{15}$ is H or alkyl, preferably $(C_1-C_8)$ alkyl, a is from 2 to 8 inclusive, b and c are each from 0 to 20 inclusive, and $R^{11}$ is $R^{20}$, as previously defined, or polyether, alkyl, aryl, or other functional side group;

and w, x, y and z are integers such that $0 \leqq w \leqq 40$, $0 \leqq x \leqq 500$, $0 \leqq y \leqq 50$, $0 \leqq z \leqq 40$.

Compounds suitable as the aminofunctional silicone of the present invention include, but are not limited to, aminoethylaminopropyl linear graft copolymer, aminoethylaminopropyl branched graft copolymer, aminoethylaminopropyl terminal linear polymers, aminoethylaminoisobutyl branched graft copolymers, aminoethylaminoisobutyl linear graft copolymers, aminoethylaminoisobutyl terminal linear polymers, aminopropyl graft linear copolymers, aminopropyl terminally substituted linear polymer, aminoethylaminopropyl linear graft terpolymer with ethylene oxide-propylene oxide side chain, and the like.

In a preferred embodiment, the aminofunctional silicone of the present invention is an aminoalkyl substituted siloxane compound which may or may not be polymeric, wherein the aminoalkyl substituent is terminally substituted, substituted on a repeating unit, or both terminally substituted and substituted on a repeating unit, of a polymeric or copolymeric species, such as an aminoalkyl terminally substituted linear siloxane, an aminoalkyl terminally substituted branched siloxane, a linear siloxane with aminoalkyl substitution on chain, a branched siloxane with an aminoalkyl substitution on chain, an aminoalkyl linear graft copolymer, an aminoalkyl branched graft copolymer, an aminoalkyl linear graft terpolymer, or an aminoalkyl branched graft terpolymer.

In one preferred embodiment, each $R^{21}$, $R^{22}$, $R^{23}$ and $R^{10}$ is $(C_1-C_8)$alkyl, $R^{11}$ is $(CH_2)_nNH(CH_2)_mNH_2$, and w and z are 0. In another preferred embodiment, each $R^{21}$, $R^{22}$, $R^{23}$, $R^{10}$ and $R^{12}$ is $(C_1-C_8)$alkyl, $R^{11}$ is $(CH_2)_nNH(CH_2)_mNH_2$, $R^{13}$ is a polyether, and w is 0. In another preferred embodiment, each $R^{21}$, $R^{22}$, $R^{23}$, $R^{10}$ and $R^{15}$ is $(C_1-C_8)$ alkyl, $R^{11}$ is $(CH_2)_nNH(CH_2)_mNH_2$, and w is >0. In another preferred embodiment, each $R^{21}$, $R^{22}$, $R^{10}$ and $R^{14}$ is $(C_1-C_8)$alkyl, $R^{23}$ is $(CH_2)NH_2$, w, y and z are 0, and x is from 2 to 100, preferably 2 to 10, preferably x is 2 or 10.

In a preferred embodiment, the dry cleaning composition of the present invention further comprises a minor amount, preferably, less than 50 pbw per 100 pbw of the composition, more preferably, less than 10 pbw per 100 pbw of the composition, of one or more non-siloxane fluids. Suitable non-siloxane fluids include aqueous fluids, such as, for example, water, and organic fluids, for example, hydrocarbon fluids and halogenated hydrocarbon fluids.

In a preferred embodiment, the dry cleaning composition of the present invention further comprises a minor amount, preferably less than 10 pbw, more preferably less than 8 pbw, even more preferably less than 5 pbw per 100 pbw of the composition, of one or more surfactants. Suitable surfactants include organic surfactants such as anionic, nonionic, cationic and amphoteric surfactants, and silicone surfactants.

An article, such as for example, a textile or leather article, typically, a garment, is dry cleaned by contacting the article with the composition of the present invention. In a preferred embodiment, the articles to be cleaned include textiles made from natural fibers, such as for example, cotton, wool, linen and hemp, from synthetic fibers, such as, for example, polyester fibers, polyamide fibers, polypropylene fibers and elastomeric fibers, from blends of natural and synthetic fibers, from natural or synthetic leather or natural or synthetic fur.

The article and dry cleaning composition are then separated, by, for example, one or more of draining and centrifugation. In a preferred embodiment, separation of the article and dry cleaning composition is followed by the application of heat, preferably, heating to a temperature of from 15° C. to 120° C., preferably from 20° C. to 100° C., or reduced pressure, preferably, a pressure of from 1 mm Hg to 750 mm Hg, or by application of both heat and reduced pressure, to the article.

Testing for water soluble stain removal was accomplished using fabric swatches supplied by the International Fabricare Institute ("IFI") (Silver Spring, Md.) that contained a water soluble dye. The color change of a swatch of this material was measured by a Minolta CR-300® Colorimeter using the Hunter Color Number difference calculations. The larger the change in Hunter Color Number (ΔE), the greater the dye removal and the more efficient the cleaning.

The following examples are to illustrate the invention and are not to be construed as limiting the claims.

EXAMPLES

Testing procedure: Circular swatches (from IFI) containing a water soluble dye were measured by the colorimeter, and the initial color values for L, a and b (as defined by the Hunter Color Numbers) were recorded. The fabric swatches were then placed in vials containing the cleaning composition of the present invention, and the vial was shaken for 10 minutes at ambient temperature. The fabric swatch was removed and allowed to drip dry for 2 to 5 seconds, then placed on absorbent toweling and allowed to air dry for 16 to 24 hours. A second reading of each fabric swatch was taken and the color difference (ΔE) was determined using the following formula:

$$\Delta E=[(L_1-L_2)^2+(a_1-a_2)^2=(b_1-b_2)^2]^{1/2}$$

This color difference represents the relative amount of cleaning, with the higher ΔE indicative of better cleaning performance.

Example 1

Aminofunctional Siloxanes

A cleaning composition according to the present invention containing a cyclic siloxane ($D_5$) and one or more aminofunctional siloxanes was made. Fabric swatches were cleaned using the above procedure, and the color difference was measured to determine the effectiveness of the cleaning composition. A solution of cyclic siloxane ($D_5$) without a surfactant was used as a control.

TABLE 1

| Amino-functional Siloxane | Milli equiv. amine/g (approx.) | Aminofunctional Siloxane Structure |
|---|---|---|
| A | 0.7 | Aminoethylaminopropyl linear graft copolymer |
| B | 0.55 | Aminoethylaminopropyl branched graft copolymer |
| C | 0.35 | Aminoethylaminopropyl linear graft terpolymer with ethylene oxide-propylene oxide side chain |
| D | 0.46 | Aminoethylaminopropyl reactive branched graft copolymer |
| E | 0.6 | Aminoethylaminopropyl reactive linear graft copolymer |
| F | 0.7 | Aminoethylaminopropyl branched graft copolymer |
| G | 5.1 | Aminopropyl terminally substituted linear polymer |
| H | 2.0 | Aminopropyl terminally substituted linear polymer |

Aminofunctional Siloxanes in $D_5$

| Exp. No. | $D_5$ (g) | Aminofunctional Siloxane | Amount (g) | ΔE |
|---|---|---|---|---|
| 1 | 14.85 | A | .15 | 1.7 |
| 2 | 14.25 | A | .75 | 4.2 |
| 3 | 14.85 | D | .15 | 1.9 |
| 4 | 14.25 | D | .75 | 2.3 |
| 5 | 14.85 | B | .15 | 1.6 |
| 6 | 14.25 | B | .75 | 1.7 |
| 7 | 14.85 | C | .15 | 3.5 |
| 8 | 14.25 | C | .75 | 13.2 |
| 9 | 14.85 | E | .15 | 2.0 |
| 10 | 14.25 | E | .75 | 1.9 |
| 11 | 14.85 | F | .15' | 1.8 |
| 12 | 14.25 | F | .75 | 1.7 |
| 13 | 14.85 | G | .15 | 6.3 |
| 14 | 14.25 | G | .75 | 14.7 |
| 15 | 14.85 | H | .15 | 2.9 |
| 16 | 14.25 | H | .75 | 11.0 |
| Control-1 | 15.00 | — | — | 1.9 |

Table 1 shows that some aminofunctional siloxanes enhance the cleaning and dye removal of the base cyclic siloxane ($D_5$) solvent.

TABLE 2

Aminofunctional Siloxanes in $D_5$ with Water Added

| Exp. No. | $D_5$ (g) | Aminofunctional Siloxane | Amount (g) | Water (g) | ΔE |
|---|---|---|---|---|---|
| 17 | 14.25 | C | 0.60 | 0.15 | 27.0 |
| 18 | 14.25 | C | 0.15 | 0.60 | 14.4 |
| 19 | 14.7 | C | 0.15 | 0.15 | 11.3 |
| 20 | 14.25 | G | 0.60 | 0.15 | 40.4 |
| 21 | 14.25 | G | 0.15 | 0.60 | 37.1 |
| 22 | 14.7 | G | 0.15 | 0.15 | 39.9 |
| 23 | 14.25 | D | 0.60 | 0.15 | 12.3 |
| 24 | 14.25 | D | 0.15 | 0.60 | 5.4 |
| 25 | 14.7 | D | 0.15 | 0.15 | 3.4 |
| 26 | 14.25 | A | 0.60 | 0.15 | 12.0 |
| 27 | 14.25 | A | 0.15 | 0.60 | 6.0 |
| 28 | 14.7 | A | 0.15 | 0.15 | 3.5 |
| 29 | 14.25 | H | 0.60 | 0.15 | 34.0 |
| 30 | 14.25 | H | 0.15 | 0.60 | 20.6 |
| 31 | 14.7 | H | 0.15 | 0.15 | 24.8 |
| Control-1 | 15.00 | — | — | — | 1.9 |
| Control-2 | 14.85 | — | — | 0.15 | 2.2 |
| Control-3 | 14.40 | — | — | 0.60 | 9.5 |

Table 2 shows that the presence of water enhanced the cleaning action of the amino silicones.

Example 3

Aminofunctional Siloxanes in $D_5$ with Acid Added

| Exp. | $D_5$ (g) | Aminofunctional Siloxane | Amt (g) | Water (g) | Acetic Acid | Delta E |
|---|---|---|---|---|---|---|
| 32 | 14.85 | C | 0.15 | — | 5 micro L | 2.65 |
| 33 | 14.25 | C | 0.75 | — | 20 micro L | 5.93 |
| 34 | 14.25 | C | 0.6 | 0.15 | 15 micro L | 6.60 |
| 35 | 14.25 | C | 0.15 | 0.6 | 5 micro L | 30.31 |
| 36 | 14.7 | C | 0.15 | 0.15 | 5 micro L | 6.55 |
| 37 | 14.85 | G | 0.15 | — | 45 micro L | 23.36 |
| 38 | 14.25 | G | 0.75 | — | 225 micro L | 30.73 |
| 39 | 14.25 | G | 0.6 | 0.15 | 180 micro L | 30.69 |
| 40 | 14.25 | G | 0.15 | 0.6 | 45 micro L | 31.98 |
| 41 | 14.7 | G | 0.15 | 0.15 | 45 micro L | 37.69 |
| 42 | 14.85 | H | 0.15 | — | 20 micro L | 23.41 |
| 43 | 14.25 | H | 0.75 | — | 90 micro L | 30.71 |
| 44 | 14.25 | H | 0.6 | 0.15 | 75 micro L | 33.22 |
| 45 | 14.25 | H | 0.15 | 0.6 | 20 micro L | 33.20 |
| 46 | 14.7 | H | 0.15 | 0.15 | 20 micro L | 32.26 |
| 47 | 14.85 | A | 0.15 | — | 10 micro L | 6.14 |
| 48 | 14.25 | A | 0.75 | — | 35 micro L | 4.66 |
| 49 | 14.25 | A | 0.6 | 0.15 | 30 micro L | 4.70 |
| 50 | 14.25 | A | 0.15 | 0.6 | 10 micro L | 3.01 |
| 51 | 14.7 | A | 0.15 | 0.15 | 10 micro L | 4.15 |
| Control 4 | 15.0 | — | — | — | 10 micro L | 2.68 |
| Control 5 | 14.85 | — | — | 0.15 | 10 micro L | 2.11 |
| Control 6 | 14.85 | — | — | 0.15 | — | 2.07 |

Table 3 shows that quaternized aminofunctional siloxanes also enhance cleaning of silicone solvents when compared to just the solvent, or solvent and water, acid or both.

TABLE 4

Aminofunctional Emulsions

| Exp. | $D_5$ (g) | Emulsion | Amt (g) | % solids | Delta E |
|---|---|---|---|---|---|
| 52 | 14.25 | 1 | 0.75 | 20 | 41.6 |
| 53 | 14.25 | 2 | 0.75 | 20 | 40.2 |
| 54 | 14.25 | 3 | 0.75 | 35 | 43.7 |
| 55 | 44.25 | 4 | 0.75 | 35 | 38.4 |

TABLE 4-continued

| Emulsion | Components of Emulsion |
|---|---|
| 1 | 2 alkyl aryl ethoxy alcohol surfactants, quaternary ammonium salt, and a curable amino siloxane |
| 2 | 2 ethoxy alkyl alcohol surfactants, ethoxylated alcohol surfactant, and a commercially available aminofunctional emulsion (with A) |
| 3 | Quaternary ammonium salt, ethoxylated alcohol surfactant and commercially available curable trialkoxyaminosilane emulsion |
| 4 | Ethoxylated dialkyl ammonium salt, alkyl aryl ethoxy alcohol, and a curable trialkoxyaminosilane emulsion |

The surfactants used in the emulsions are known in the art and are commercially available as such trade names, for example, as Triton, Tergitol, Varisoft and the like.

Table 4 illustrates that emulsions of aminofunctional siloxanes and aminofunctional silanes, in conjunction with organic surfactants, are also effective at cleaning water soluble stains.

The present invention exhibits improved performance of dry cleaning agents for stain removal, particularly water soluble stains, through the addition of an aminofunctional silicone, and optionally water, acid or organic surfactants.

What is claimed is:

1. A dry cleaning composition having 100 parts by weight, comprising a volatile cyclic, linear or branched siloxane in an amount ranging from about 90 to about 99.999 parts by weight of the volatile siloxane, an aminofunctional siloxane in an amount ranging from about 0.001 part to less than 10 parts by weight of the aminofunctional siloxane and water in an amount ranging from about 0.01 to about 15 parts by weight.

2. The composition of claim 1, wherein the aminofunctional siloxane comprises structural units of the formula:

$$R^{20}_f SiO_{4-f}$$

wherein at least one $R^{20}$ is $—(CHR^{24})_n NR^{25}R^{26}$ where $R^{24}$ is H or alkyl, $R^{25}$ is H or alkyl, $R^{26}$ is H, alkyl, or $—(CHR^{27})_m NR^{28}R^{29}$ where $R^{27}$ is H or alkyl, and $R^{28}$ and $R^{29}$ are each independently H or alkyl, n is from 2 to 16, and m is from 2 to 16; and $1 \leqq f \leqq 3$.

3. The composition of claim 2, wherein the aminofunctional silicone comprises one or more siloxanes selected from block or random polymers and copolymers and terminally substituted aminofunctional siloxane polymers having the structural formula:

$$M^*D_xD'_yT_wT'_zM^* \quad (I)$$

wherein $M^*$ is $R^{21}R^{22}R^{23}SiO_{1/2}$, wherein each $R^{21}$, $R^{22}$ and $R^{23}$ is independently alkyl, aryl, substituted alkyl or aryl, alkoxy, $—(CH_2)_a(CH_2CH_2O)_b(CH_2CH(CH_3)O)_cR^{15}$, wherein $R^{15}$ is H or alkyl, a is from 2 to 8 inclusive, b and c are each from 0 to 20 inclusive, or $R^{20}$, as previously defined;

D is $R^{14}{}_2SiO_{2/2}$, wherein each $R^{14}$ is alkyl or $—(CH_2)_a(CH_2CH_2O)_b(CH_2CH(CH_3)O)_cR_{15}$, wherein $R_{15}$ is H or alkyl, a is from 2 to 8 inclusive, b and c are each from 0 to 20 inclusive;

D' is $R^{10}R^{11}SiO_{2/2}$, wherein $R^{10}$ is alkyl, aryl, or $—(CH_2)_a(CH_2CH_2O)_b(CH_2CH(CH_3)O)R^{15}$, wherein $R^{15}$ is H or alkyl, a is from 2 to 8 inclusive, b and c are each from 0 to 20 inclusive, and $R^{11}$ is $R^{20}$, as previously defined, or polyether, alkyl, aryl, or other functional side group;

T is $R^{12}SiO_{3/2}$, wherein $R^{12}$ is alkyl or aryl, or

—$(CH_2)_a(CH_2CH_2O)_b(CH_2CH(CH_3)O)_cR^{15}$, wherein $R^{15}$ is H or alkyl;

T' is $R^{13}SiO_{3/2}$, wherein $R^{13}$ is alkyl, aryl, or

—$(CH_2)_a(CH_2CH_2O)_b(CH_2CH(CH_3)O)_cR^{15}$, wherein $R^{15}$ is H or alkyl, a is from 2 to 8 inclusive, b and c are each from 0 to 20 inclusive, and $R^{11}$ is $R^{20}$, as previously defined, or polyether, alkyl, aryl, or other functional side group;

and w, x, y and z are integers such that $0 \leqq w \leqq 40$, $0 \leqq x \leqq 500$, $0 \leqq y \leqq 50$, $0 \leqq z \leqq 40$.

4. The composition of claim 3, wherein each $R^{21}$, $R^{22}$, $R^{23}$ and $R^{10}$ is $(C_1–C_8)$alkyl, $R^{11}$ is $(CH_2)_nNH(CH_2)_mNH_2$, and w and z are 0.

5. The composition of claim 3, wherein each $R^{21}$, $R^{22}$, $R^{23}$, $R^{10}$ and $R^{12}$ is $(C_1–C_8)$alkyl, $R^{11}$ is $(CH_2)_nNH(CH_2)_mNH_2$, $R^{13}$ is a polyether, and w is 0.

6. The composition of claim 3, wherein each $R^{21}$, $R^{22}$, $R^{23}$, $R^{10}$ and $R^{15}$ is $(C_1–C_8)$alkyl, $R^{11}$ is $(CH_2)_nNH(CH_2)_mNH_2$, and w is >0.

7. The composition of claim 3, wherein each $R^{21}$, $R^{22}$, $R^{10}$ and $R^{14}$ is $(C_1–C_8)$alkyl, $R^{23}$ is $(CH_2)NH_2$, w, y and z are 0, and x is from 2 to 100.

8. The composition of claim 7, wherein x is from 2 to 10.

9. The composition of claim 8, wherein x is 2 or 10.

10. The composition of claim 1, wherein the linear or branched, volatile siloxane comprises one or more compounds of the structural formula:

$$M_{2+y+2z}D_xT_yQ_z$$

wherein:

M is $R^1{}_3SiO_{1/2}$;

D is $R^2R^3SiO_{2/2}$;

T is $R^4SiO_{3/2}$;

and Q is $SiO_{4/2}$ $R^1$, $R^2$, $R^3$ and $R^4$ are each independently a monovalent hydrocarbon radical; and x and y are each integers, wherein $0 \leqq x \leqq 10$ and $0 \leqq y \leqq 10$ and $0 \leqq z \leqq 10$.

11. The composition of claim 1, wherein the cyclic siloxane component comprises one or more compounds of the structural formula:

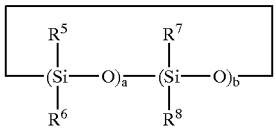

wherein:

$R^5$, $R^6$, $R^7$ and $R^8$ are each independently a monovalent hydrocarbon group; and a and b are each integers wherein $0 \leqq a \leqq 10$ and $0 \leqq b \leqq 10$, provided that $3 \leqq (a+b) \leqq 10$.

12. A method for dry cleaning an article, comprising contacting the article with a composition comprising a volatile cyclic, linear or branched siloxane in an amount ranging from about 90 to about 99.999 parts by weight of the volatile siloxane, an aminofunctional siloxane in an amount ranging from about 0.001 part to less than 10 parts by weight of the aminofunctional siloxane and water in an amount ranging from about 0.01 to about 15 parts by weight.

13. The method of claim 12, wherein the aminofunctional siloxane comprises structural units of the formula:

$$R^{20}{}_fSiO_{4-f}$$

wherein at least one $R^{20}$ is —$(CHR^{24})_nNR^{25}R^{26}$ where $R^{24}$ is H or alkyl, $R^{25}$ is H or alkyl, $R^{26}$ is H, alkyl, or —$(CHR^{27})_mNR^{28}R^{29}$ where $R^{27}$ is H or alkyl, and $R^{28}$ and $R^{29}$ are each independently H or alkyl, n is from 2 to 16, and m is from 2 to 16; and $1 \leqq f \leqq 3$.

14. The method of claim 13, wherein the aminofunctional silicone comprises one or more siloxanes selected from block or random polymers and copolymers and terminally substituted aminofunctional siloxane polymers having the structural formula:

$$M^*D_xD'_yT_wT'_zM^* \quad (I)$$

wherein

M* is $R^{21}R^{22}R^{23}SiO_{1/2}$, wherein each $R^{21}$, $R^{22}$ and $R^{23}$ is independently alkyl, aryl, substituted alkyl or aryl, alkoxy, —$(CH_2)_a(CH_2CH_2O)_b(CH_2CH(CH_3)O)_cR^{15}$, wherein $R^{15}$ is H or alkyl, a is from 2 to 8 inclusive, b and c are each from 0 to 20 inclusive, or $R^{20}$, as previously defined;

D is $R^{14}{}_2SiO_{2/2}$, wherein each $R^{14}$ is alkyl or

—$(CH_2)_a(CH_2CH_2O)_b(CH_2CH(CH_3)O)_cR^{15}$, wherein $R^{15}$ is H or alkyl, a is from 2 to 8 inclusive, b and c are each from 0 to 20 inclusive;

D' is $R^{10}R^{11}SiO_{2/2}$, wherein $R^{10}$ is alkyl, aryl, or

—$(CH_2)_a(CH_2CH_2O)_b(CH_2CH(CH_3)O)_cR^{15}$, wherein $R^{15}$ is H or alkyl, a is from 2 to 8 inclusive, b and c are each from 0 to 20 inclusive, and $R^{11}$ is $R^{20}$, as previously defined, or polyether, alkyl, aryl, or other functional side group;

T is $R^{12}SiO_{3/2}$, wherein $R^{12}$ is alkyl or aryl, or

—$(CH_2)_a(CH_2CH_2O)_b(CH_2CH(CH_3)O)_cR^{15}$, wherein $R^{15}$ is H or alkyl;

T' is $R^{13}SiO_{3/2}$, wherein $R^{13}$ is alkyl, aryl, or

—$(CH_2)_a(CH_2CH_2O)_b(CH_2CH(CH_3)O)_cR^{15}$, wherein $R^{15}$ is H or alkyl, a is from 2 to 8 inclusive, b and c are each from 0 to 20 inclusive, and $R^{11}$ is $R^{20}$, as previously defined, or polyether, alkyl, aryl, or other functional side group;

and w, x, y and z are integers such that $0 \leqq w \leqq 40$, $0 \leqq x \leqq 500$, $0 \leqq y \leqq 50$, $0 \leqq z \leqq 40$.

15. The method of claim 14, wherein each $R^{21}$, $R^{22}$, $R^{23}$ and $R^{10}$ is $(C_1–C_8)$alkyl, $R^{11}$ is $(CH_2)_nNH(CH_2)_mNH_2$, and w and z are 0.

16. The method of claim 14, wherein each $R^{21}$, $R^{22}$, $R^{23}$, $R^{10}$ and $R^{12}$ is $(C_1–C_8)$alkyl, $R^{11}$ is $(CH_2)_nNH(CH_2)_mNH_2$, $R^{13}$ is a polyether, and w is 0.

17. The method of claim 14, wherein each $R^{21}$, $R^{22}$, $R^{23}$, $R^{10}$ and $R^{15}$ is $(C_1–C_8)$alkyl, $R^{11}$ is $(CH_2)_nNH(CH_2)_mNH_2$, and w is >0.

18. The composition of claim 14, wherein each $R^{21}$, $R^{22}$, $R^{10}$ and $R^{14}$ is $(C_1–C_8)$alkyl, $R^{23}$ is $(CH_2)NH_2$, w, y and z are 0, and x is from 2 to 100.

* * * * *